US005619813A

United States Patent [19]

Forest et al.

[11] Patent Number: 5,619,813

[45] Date of Patent: Apr. 15, 1997

[54] MULTILAYER IRON SOLEPLATE MADE UP OF CO-LAMINATED MATERIALS

[75] Inventors: Michel Forest, Vienne; Jean-Louis Brandolini, Saint-Etienne, both of France

[73] Assignee: SEB S.A., Selongey, France

[21] Appl. No.: 448,568

[22] PCT Filed: Jan. 21, 1994

[86] PCT No.: PCT/FR94/00077

§ 371 Date: Jun. 21, 1995

§ 102(e) Date: Jun. 21, 1995

[87] PCT Pub. No.: WO94/17236

PCT Pub. Date: Aug. 8, 1994

[30] Foreign Application Priority Data

Jan. 25, 1993 [FR] France ..... 93 00910

[51] Int. Cl.[6] ..... D06F 75/38

[52] U.S. Cl. ..... 38/93; 29/904; 29/DIG. 32

[58] Field of Search ..... 38/93, 80, 81; 29/33 C, 33 E, 238, 904, DIG. 32

[56] References Cited

U.S. PATENT DOCUMENTS

| | | | |
|---|---|---|---|
| 68,178 | 8/1867 | Fraser | 38/93 |
| 2,298,113 | 10/1942 | Ely | 38/93 |
| 2,782,498 | 2/1957 | Mushovic et al. | 29/DIG. 32 |
| 2,807,700 | 9/1957 | Jepson | 38/88 X |
| 2,846,793 | 8/1958 | Studer | 38/93 X |
| 3,142,916 | 8/1964 | Jacobson | 38/97 |

FOREIGN PATENT DOCUMENTS

| | | | |
|---|---|---|---|
| 1502451 | 2/1968 | France . | |
| 2176505 | 12/1986 | United Kingdom . | |
| 2225345 | 5/1990 | United Kingdom . | |
| 4018372 | 8/1994 | WIPO | 38/93 |

*Primary Examiner*—Ismael Izaguirre
*Attorney, Agent, or Firm*—Loeb & Loeb LLP

[57] ABSTRACT

An iron. The invention relates to a soleplate for an iron, the soleplate comprising a casting (1) secured to a metal ironing cover (4) made up of at least two layers of different materials, said soleplate being characterized in that the metal cover (4) is made up of an assembly comprising at least two layers (5, 6) of co-laminated materials, in which assembly the first layer (5) forms the layer for fixing to the casting (1) and is constituted by the same material as the casting (1) or by a material having similar physical characteristics, and the second layer (6) forms the ironing layer, the thickness of the second layer lying in the range 5% to 40% of the thickness of the first layer (5), and preferably in the range 15% to 17%. A soleplate for an iron.

22 Claims, 1 Drawing Sheet

MULTILAYER IRON SOLEPLATE MADE UP OF CO-LAMINATED MATERIALS

TECHNICAL FIELD

The present invention relates to a soleplate for an iron, the soleplate comprising a casting having a metal ironing cover fixed thereon by fixing means.

PRIOR ART

The casting of an iron is a part which is generally made of aluminum, and which has a metal cover mounted directly thereon to form the ironing soleplate. It is already known that a stainless steel metal cover can be mounted on the aluminum casting and can be fixed by means of a silicone adhesive. Fixing may be improved by clipping the periphery of the cover onto the soleplate. To make such an ironing soleplate, it is necessary to machine some of the surfaces of the casting prior to fixing on the metal cover. As a result, making such an iron soleplate involves various steps that increase the final cost of the product. Furthermore, because of large differences between the coefficients of thermal expansion of the aluminum casting and of the stainless steel metal cover, the strength and the structural integrity of the soleplate deteriorate over time. This gives rise to play between the various layers, and to progressively worsening heat transmission during the life of the iron.

Admittedly, alternatives or improvements, such as increasing the relative thickness of the stainless steel sheet, do indeed improve the stability of the soleplate over time to some extent, but they also reduce heat transfer, and clearly they also increase the cost of the finished product.

Naturally, co-laminated materials are also well known, and they are already used in particular in automobile construction. In that field, co-laminated materials of the two-layer aluminum-and-stainless steel type are used because of the anti-corrosion properties of stainless steel and because of its pleasing appearance.

Aluminum-and-stainless steel type co-laminated materials are also used to make the bottoms of some kinds of saucepans. Such materials are used for that purpose because of the heat diffusion provided by aluminum and because of the appearance provided by the outer layer of stainless steel, but no concern is given to the large difference between the respective coefficients of thermal expansion of those two co-laminated materials, which difference gives rise to a well known effect whereby the bottom of the saucepan bulges. Because of the methods of heating that are used, and in view of the relative unimportance of the heat transmission factor for such cooking utensils, this phenomenon whereby the bottom of the saucepan bulges and the structure of its bottom becomes somewhat spoiled has always been accepted.

In order to make soleplates for irons, it is also known that layers of different metals can be assembled together by means of solid phase bonding. Such soleplates are described in Document FR-A-1 502 451 and they are associated with an additional layer of "bonding" metal which is heated to its melting point so as to obtain metallurgical bonding when the casting of the iron is cast on the soleplate. Document FR-A-1 502 451 also describes a method of making a soleplate for an iron and of fixing it to the casting of the iron while said casting is being cast. Such a method suffers from significant drawbacks, e.g. the complexity and the cost of the means required to implement it.

DESCRIPTION OF THE INVENTION

An object of the present invention is to remedy the above-mentioned problems encountered in making soleplates for irons, and to provide a novel soleplate which is simpler to make and which does not require any surface preparation, while retaining good heat exchange properties and without any significant deformation.

Another object of the invention is to provide a soleplate for an iron, in which thermal expansion is accommodated so as to guarantee a long life-span for the soleplate, as well as good quality ironing.

Another object of the invention is to provide an iron in which it is particularly simple and cheap to fix the metal cover to the casting.

Another object of the invention is to provide a novel use for co-laminated materials in the field of household appliances, as well as a method of assembling together a casting and a metal ironing cover.

The invention achieves the above objects by providing a soleplate for an iron, the soleplate comprising a casting secured to a metal ironing cover made up of at least two layers of different materials, said soleplate being characterized in that the metal cover is made up of an assembly comprising at least two layers of co-laminated materials, in which assembly the first layer forms the layer for fixing to the casting and is constituted by the same material as the casting or by a material having similar physical characteristics, and the second layer forms the ironing layer, the thickness of the second layer lying in the range 5% to 40% of the thickness of the first layer, and preferably in the range 15% to 17%.

The invention also achieves the objects by providing use of a co-laminated material based on at least two layers as a metal ironing cover for an iron.

The invention also achieves the above objects by providing a method of making a soleplate for an iron, in which method a casting is secured to a metal ironing cover made up of at least two layers of different materials, said method being characterized in that it consists in taking a metal cover made up of at least two layers of co-laminated materials, in mounting said cover on the already-formed casting, and in fixing it thereto by fixing means.

BRIEF DESCRIPTION OF THE DRAWING

Other features and advantages of the invention will appear in more detail on reading the following description given by way of non-limiting example with reference to the accompanying drawing, in which.

MANNER OF PERFORMING THE INVENTION

Figure 1:
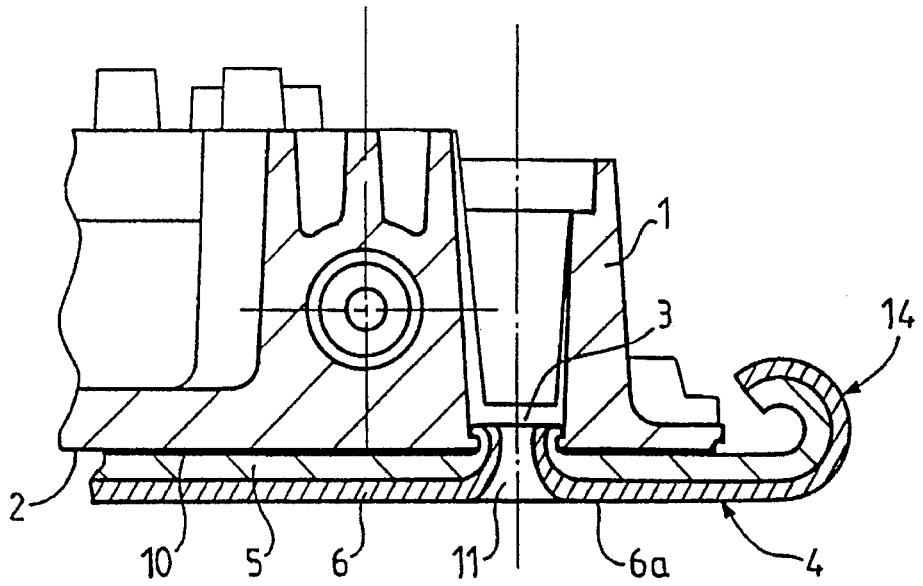
FIG. 1 is a fragmentary cross-section view showing the structure of an iron soleplate of the invention.

The iron soleplate shown in FIG. 1 includes a casting 1 cast in one piece, e.g. made of aluminum, and delimiting a substantially plane bottom face 2. The top portion of the casting 1 defines a series of cavities and channels which co-operate with a plate that closes the steam chamber and with a thermal skirt (not shown in the figures) to form the various compartments and elements that are essential to a steam iron. In the embodiment shown in FIG. 1, the iron soleplate is designed for a steam iron, and the casting 1 is provided with a series of openings 3 for that purpose, the openings communicating with a steam chamber (not shown in the figures). However, the invention may be applied to a dry iron.

As shown in FIG. 1, the iron soleplate of the invention further includes a metal cover 4 made up of an assembly comprising at least two layers of co-laminated materials. The metal cover 4 includes a first layer 5 which forms the fixing layer for fixing to the bottom face 2 of the casting 1. The first layer 5 is substantially plane and it is constituted by a material that is identical or at least that has similar physical characteristics to the material of the casting 1. The term "similar physical characteristics" essentially refers to physical characteristics relating to its coefficient of thermal expansion and/or to its hardness of the material and/or to its thermal conductivity. The co-laminated metal cover 4 also includes a second layer 6 whose outside face 6*a* forms the ironing layer.

In a particularly advantageous variant embodiment, the casting is made of aluminum, and the metal cover comprises a two-layer co-laminated assembly in which the first layer 5 is also constituted by aluminum, while the second layer 6 is constituted by stainless steel. In another variant, the first layer 5 may be constituted by a material having similar physical characteristics to aluminum, such as copper, and the second layer 6 may be constituted by copper, by nickel, or by titanium.

To accommodate the differences in thermal expansion between the first layer 5 and the second layer 6, it is particularly advantageous to maintain a specific thickness ratio between said layers. For that purpose, the thickness of the second layer 6 lies in the range 5% to 40% of the thickness of the first layer 5, and preferably in the range 15% to 17%. Preferably, the thickness of the second layer lies firstly in the range 5% to 12% of the thickness of the first layer 5 and secondly in the range 14% to 40%, or else in the range 15% to 40%, or even in the range 15% to 20%. Naturally, other preferred ranges such as 20% to 40% or 30% to 40% may be considered.

In another particularly advantageous embodiment of the invention, the total thickness of the co-laminated metal cover 4 corresponding to the sum of the thicknesses of the first layer 5 and of the second layer 6 lies in the range 1.6 mm to 2 mm, and preferably in the range 1.7 mm to 1.9 mm. Advantageously, the thickness of the second layer 6 lies in the range 0.1 mm to 0.4 mm and preferably in the range 0.2 mm to 0.3 mm, while the thickness of the first layer 5 lies in the range 1.4 mm to 1.7 mm, and preferably in the range 1.5 mm to 1.6 mm. The above-mentioned thickness ranges are particularly advantageous for a co-laminated material of the aluminum-and-stainless steel type.

In another variant embodiment, the metal cover 4 may be made up of three layers of co-laminated materials, the first layer 5 being of aluminum or copper, the second layer 6 being of copper or stainless steel, and the intermediate layer (not shown in the figures) being of aluminum, copper, or ordinary steel.

Metal covers made in this way are of the aluminum-steel-stainless steel type, or preferably of the aluminum-copper-stainless steel type, or else of the copper-aluminum-stainless steel type. Each of the relative thicknesses of the first layer 5 and of the second layer 6 represent in the range 15% to 17% of the total thickness of the three-layer cover, with the intermediate layer representing in the range 66% to 70% of the total thickness. Naturally, when steel is used for an intermediate layer, the type of steel used is chosen on the basis of its suitability for improving the strength of the co-laminated assembly, and also on the basis of its thermal conductivity and expansion properties.

The co-laminated metal cover 4 is mounted on the casting 1 and is then fixed thereto by fixing means. The fixing means comprise a layer of adhesive 10 that is preferably heat-resistant and/or that is based on polymerized silicone adhesive, and that extends between the bottom face 2 and the first layer 5.

When the iron soleplate is to be used in a steam iron, it is provided with steam holes 11 which are crimped onto the casting 1 inside orifices 3. In which case, the crimped material forms the fixing means which may be additional to the layer of adhesive 10.

Figure 2:
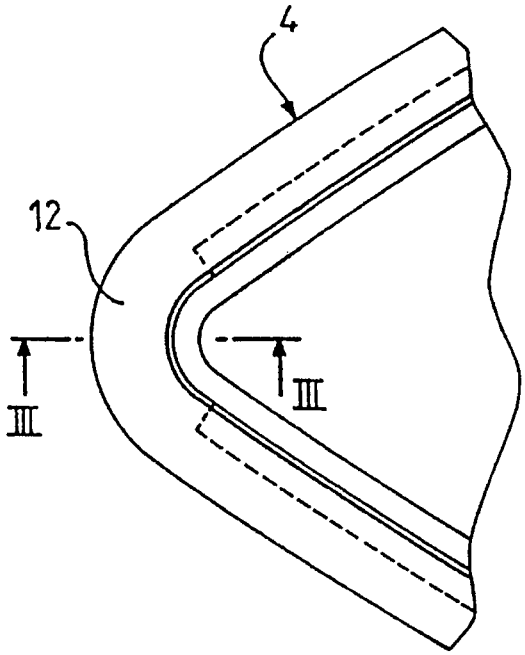
FIG. 2 is a fragmentary top view of the tip of an iron soleplate of the invention, showing one of the means of fixing said soleplate.
Figure 3:
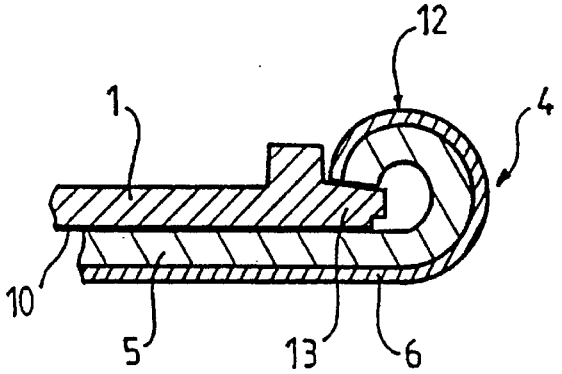
FIG. 3 is a fragmentary cross-section view on line III—III of FIG. 2, showing the fixing means shown in FIG. 2.

To supplement fixing of the co-laminated metal cover 4, said cover may optionally be clipped mechanically to the casting 1 at at least one point. For that purpose, the metal cover 4 is provided with at least one zone forming a folded-over margin 12 which abuts via its edge against a peripheral border 13 of the casting 1. Because of the non-uniformity of the temperatures in the ironing soleplate, the folded-over margin 12 is provided at the front of the soleplate, where the cover is subject to the most stress, so as to constituted a clip-on tip (FIGS. 2 and 3).

In another variant embodiment of the invention, the entire perimeter of the metal cover 4 is provided with a rolled-over peripheral margin 14 (FIG. 1) extending the second layer 6 and providing improved mechanical strength for the soleplate.

In an additional variant of the iron soleplate of the invention, the metal cover 4 is secured to the casting 1 by fixing means that are exclusively mechanical, e.g. constituted by bolts or by rivets. A combination of various mechanical means may be considered, with or without a layer of adhesive 10 being used.

By using a co-laminated material based on at least two layers, preferably aluminum-stainless steel, as the metal ironing cover for an iron, it is possible to combine the advantages of both of the co-laminated metals. The first layer 5, constituted by a material that is the same as or similar to the material of the casting, provides both good thermal conduction and also optimum adhesion and fixing, thereby improving overall stability by means of the uniformity of the materials. The second layer 6 provides pleasing appearance and gives the soleplate good sliding properties without comprising the structural integrity of the co-laminated assembly despite the large differences in coefficient of thermal expansion, and the risks of deformation allowed for in the soleplate as a whole. No shearing has been observed between the stainless steel and the aluminum, and, by making the casting of aluminum and the first layer 5 of aluminum as well, it is possible to omit any surface-machining operations without observing any degradation in mechanical strength or any loss of heat transmission.

The thicknesses used also make it possible for the layers of the co-laminated assembly to expand differentially without giving rise to any mechanical deterioration in the structure of the soleplate. In particular, since the aluminum layer expands to a larger extent than the stainless steel layer, a small amount of tension is applied to the surface of the stainless steel layer, thereby improving its sliding performance.

The method of making an iron soleplate of the invention consists in taking a metal cover 4 made up of at least two layers of co-laminated materials 5, 6, and in using fixing means 3, 10, 12 to fix said cover to the casting 1 that has already been formed by using any known technique, e.g. by being cast in a mold. Since the casting 1 is in the form of a single piece that is easy to transport, it can be secured to the metal cover 4 easily and it lends itself well to any industrial handling end assembly operations. The method of the invention also consists in mounting the metal ironing cover 4 on the casting 1 and then fixing it thereto without any surface preparation, since the fixing means 3, 10, 12 are of the mechanical type. The method of the invention further consists in using a co-laminated assembly based on at least two layers of materials having compositions and thicknesses as defined above, and in spreading a layer of heat-resistant adhesive on the surface of the first layer 5 that comes into contact with the casting 1, so as to constitute the mechanical fixing means 3, 10, 12 at least in part.

POSSIBILITIES OF INDUSTRIAL EXPLOITATION

The invention can be applied to making iron soleplates, in particular steam iron soleplates.

We claim:

1. A soleplate for an iron, the soleplate comprising a casting (1) secured to a metal ironing cover (4) made up of at least two layers of different materials, said soleplate being characterized in that the metal cover (4) is made up of an assembly comprising at least two layers (5,6) of co-laminated materials, in which assembly the first layer (5) forms the layer for fixing to the casting (1) and is constituted by the same material as the casting (1) or by a material having similar physical characteristics, and the second layer (6) forms the ironing layer, the thickness of the second layer lying in the range 5% to 40% of the thickness of the first layer (5).

2. A soleplate according to claim 1, characterized in that the total thickness of the first layer (5) and of the second layer (6) lies in the range 1.6 mm to 2 mm.

3. A soleplate according to claim 2 wherein the total thickness of the first layer and of the second layer is in the range of 1.7 mm to 1.9 mm.

4. A soleplate according to claim 1, characterized in that the thickness of the second layer (6) lies in the range 0.1 mm to 0.4 mm, and the thickness of the first layer (5) lies in the range 1.4 mm to 1.7 mm.

5. A soleplate according to claim 4 wherein the thickness of the second layer is in the range 0.2 mm to 0.3 mm and the thickness of the first layer is in the range 1.5 mm to 1.6 mm.

6. A soleplate claim 1 characterized in that the metal cover (4) consists of two layers (5, 6) of co-laminated materials.

7. A soleplate according to claim 6, characterized in that the casting (1) is made of aluminum, the first layer (5) is constituted by a material from the following group; copper and aluminum, and the second layer (6) is constituted by a material from the following group: copper, nickel, titanium, and stainless steel.

8. A soleplate according to claim 1, characterized in that the metal cover (4) is mounted on a casting made of aluminum, and is made up of three layers of co-laminated materials, the first layer (5) being constituted by a material from the following group: copper and aluminum, the second layer (6) being constituted by a material from the following group: stainless steel and copper, and the intermediate layer being constituted by a material from the following group: aluminum, copper and steel.

9. A soleplate according to claim 8, characterized in that each of the first and second layers (5, 6) represents in the range 15% to 17% of the total thickness of the three-layer cover (4).

10. A soleplate according to claim 1, characterized in that the casting (1) is secured to the metal cover (4) by fixing means which include a layer of adhesive (10).

11. A soleplate according to claim 10 wherein the layer of adhesive is based on a polymerized silicone adhesive.

12. A soleplate according to claim 1, characterized in that the metal cover is provided with a series of openings (3), said cover being crimped onto the casting (1) via said openings, whose crimped material forms fixing means.

13. A soleplate according to claim 1, characterized in that the metal cover (4) includes at least one zone forming a folded-over margin (12) abutting against the casting (1) and forming fixing means.

14. A soleplate according to claim 13 wherein said folded-over margin (12) is situated at the front of the soleplate so as to constitute a clip-on tip.

15. A soleplate according to claim 1 characterized in that the metal cover includes a rolled-over peripheral margin (14).

16. An iron comprising a soleplate according to claim 1.

17. A soleplate according to claim 1 wherein the thickness of the second layer is in the range of 15% to 17% of the thickness of the first layer.

18. A soleplate according to claim 1 wherein said casting is fabricated separately from said ironing cover and is secured to said ironing cover subsequent to fabrication of said casting.

19. A method of making a soleplate for an iron, in which method a casting (1) is secured to a metal ironing cover (4) made up of at least two layers of different materials (5,6), said method being characterized in that it comprises taking a metal cover (4) made up of at least two layers of co-laminated materials (5,6), mounting said cover on the already-formed casting (1), and fixing the metal cover to the casting by fixing means (3,10,12).

20. A method according to claim 19, characterized in that it consists in mounting the metal ironing cover (4) on the casting (1) and in then fixing it thereto without any surface preparation.

21. A method according to claim 19, characterized in that it consists in:

using a first layer (5) of the metal cover (4) as a fixing layer for fixing via mechanical-type fixing means (3, 10, 12);

using the same material as the casting (1) or a material having similar physical characteristics for said first layer (5); and using the second layer (6) to form the ironing layer, the thickness of the second layer (6) lying in the range 5% to 40% of the thickness of the first layer (5), and preferably in the range 15% to 17%.

22. A method according to claim 19, characterized in that it consists in spreading a layer of heat-resistant adhesive on the surface of the first layer (5) that comes into contact with the casting (1) so as to constitute the fixing means (3, 10, 12) at least in part.

* * * * *